US008627877B2

(12) United States Patent
Gerlach

(10) Patent No.: US 8,627,877 B2
(45) Date of Patent: Jan. 14, 2014

(54) CORE OR FOUNDRY SAND COATED AND/OR MIXED WITH WATER GLASS WITH A WATER CONTENT IN THE RANGE OF ≥ APPROXIMATELY 0.25% BY WEIGHT TO APPROXIMATELY 0.9% BY WEIGHT

(75) Inventor: Ralf-Joachim Gerlach, Krefeld (DE)

(73) Assignee: Minelco GmbH, Essen (DE)

( * ) Notice: Subject to any disclaimer, the term of this patent is extended or adjusted under 35 U.S.C. 154(b) by 0 days.

(21) Appl. No.: 13/062,619

(22) PCT Filed: Aug. 25, 2009

(86) PCT No.: PCT/EP2009/006153

§ 371 (c)(1),
(2), (4) Date: May 19, 2011

(87) PCT Pub. No.: WO2010/025861

PCT Pub. Date: Mar. 11, 2010

(65) Prior Publication Data

US 2011/0226436 A1 Sep. 22, 2011

(30) Foreign Application Priority Data

Sep. 5, 2008 (EP) ..... 08015735

(51) Int. Cl.
*B22C 9/02* (2006.01)
*B22C 9/10* (2006.01)
*B22C 1/18* (2006.01)

(52) U.S. Cl.
USPC ..... 164/522; 164/349; 164/369; 106/38.2

(58) Field of Classification Search
USPC ..... 164/7.1, 522, 349, 369, 159; 106/38.2, 106/38.9
See application file for complete search history.

(56) References Cited

U.S. PATENT DOCUMENTS

| | | | | |
|---|---|---|---|---|
| 3,804,643 | A | 4/1974 | Arita et al. | |
| 6,248,284 | B1 * | 6/2001 | Huusmann | 264/463 |
| 6,371,194 | B1 | 4/2002 | Steinhäuser | |
| 7,022,178 | B1 | 4/2006 | Steinhäuser | |
| 2002/0029862 | A1 | 3/2002 | Steinhäuser | |
| 2005/0178520 | A1 | 8/2005 | Franklin et al. | |

FOREIGN PATENT DOCUMENTS

| | | | |
|---|---|---|---|
| AU | 424837 | | 5/1968 |
| DE | 19632293 | A1 | 2/1998 |
| DE | 19951622 | | 5/2001 |
| DE | 10321106 | A1 | 12/2004 |
| EP | 0739666 | A1 | 10/1996 |
| EP | 0796681 | A2 | 9/1997 |
| EP | 0917499 | A2 | 5/1999 |
| JP | 60044147 | A | 3/1985 |
| WO | WO 98/29208 | | 7/1998 |
| WO | WO 99/58268 | | 11/1999 |
| WO | WO 99/58269 | | 11/1999 |

OTHER PUBLICATIONS

Rabii, "Sodium Silicate Glass as an Inorganic Binder in Foundry Industry", Iranian Polymer Journal, 2001, pp. 229-235, vol. 10, No. 4.

* cited by examiner

*Primary Examiner* — Kevin P Kerns
(74) *Attorney, Agent, or Firm* — Berenato & White, LLC

(57) ABSTRACT

A core or foundry sand that can be used for the production of cores and casting molds for the casting of molten metals includes a basic molding material, a layer of an adhesive agent coating the basic molding material, and a layer of water glass lying over the adhesive agent layer. The core or foundry sand has a water content in the range of ≤ approximately 0.25% by weight to approximately 0.9% by weight in relation to the overall weight of the core or foundry sand.

19 Claims, No Drawings

CORE OR FOUNDRY SAND COATED AND/OR MIXED WITH WATER GLASS WITH A WATER CONTENT IN THE RANGE OF ≥ APPROXIMATELY 0.25% BY WEIGHT TO APPROXIMATELY 0.9% BY WEIGHT

CROSS-REFERENCE TO RELATED APPLICATIONS AND CLAIM TO PRIORITY

This application relates to International Application No. PCT/EP2009/006153 filed Aug. 25, 2009 and European Patent Application No. 08015735.7 filed Sep. 5, 2008, of which the disclosures are incorporated herein by reference and to which priority is claimed.

FIELD OF THE INVENTION

The invention relates to a core or foundry sand for the production of cores and casting moulds for the casting of molten metals, the latter comprising a basic moulding material (e.g. quartz sand, chrome ore sand, zircon sand, olivine sand, synthetic sands) which contains water glass, and the core or foundry sand having a water content in the range of from≥approximately 0.25% by weight to approximately 0.9% by weight in relation to the overall weight of the core and foundry sand. Furthermore, the invention relates to a method for the production of this type of core or foundry sand and to a method for the production of a core or a casting mould with this core or foundry sand and use of the latter.

BACKGROUND

Core or foundry sands for the production of cores or other casting moulds are known. Generally the latter are initially brought into the desired shape by a tool, such as a core tool, reproducing the casting mould being filled with the core or foundry sand and the core or foundry sand then being compacted and hardened. After opening the tool the desired mould part, for example a casting core, can be removed. By using this casting core molten metals, including aluminium light molten metals, can be cast into the desired shape. After the molten metal has solidified the casting core or the casting mould can be removed for example by shaking. Due to the shaking the previously strong and stable casting core/mould disintegrates.

A known method for the production of core or foundry sand is also called the "Croning method" after its inventor. Here a fine-grained quartz sand is used as the basic moulding material with which every grain of sand is coated with a thermoplastic phenolic resin layer. The phenolic resins are solid before heating in the non-hardened state at ambient temperature. If the core or foundry sand is now introduced into a cavity forming a mould part, such as a tool reproducing the casting mould, for example a core tool, and heated to 250° C. to 300° C., the binder film melts and binder bridges form due to polycondensation which when the polycondensation reaction is complete are solid and have duroplastic properties. The finished core or the finished mould can be removed from the tool.

The advantage of the core or foundry sand used with the Croning method in comparison to the other well-established core/mould production methods (e.g. cold box, hot box, furanic resin, water glass $CO_2$ methods) is that unlike the previously specified methods the hardening reaction does not start directly after mixing, but only when heat is reintroduced (250°-300° C.). The storage life of the ready-mixed core or foundry sand is practically unlimited with correct storage.

When being processed the core or foundry sand shows good flowability, good reproduction accuracy, a high level of dimensional accuracy, very sharp edges and a high surface quality. However, it is a disadvantage with the Croning method that the tool temperature chosen for the production of the cores or the mould parts from the core or foundry sand must be exceptionally high, and this leads to a high energy requirement. When subsequently casting with a molten metal at approximately 700° C-1700° using cores and mould parts which have been produced using the Croning method the phenolic resin burns, releasing emissions harmful to health and to the environment (e.g. mono- and polycyclic aromatics). Disposal of the core and mould parts used after casting also constitutes an environmental problem because the latter can only be disposed of with a high level of financial expenditure (special waste disposal). Possible heat regeneration is also associated with extremely high costs and impact upon the environment.

In order to avoid environmental problems, it is also known to use a basic moulding material with an inorganic, for example water glass-based binder. Here the basic moulding material is mixed with an aqueous solution of water glass and is then poured directly into a moulding tool. In order to solidify the core or foundry sand to form a mould part heat can be introduced in order to solidify the core or foundry sand by means of dehydration (physical hardening).

With another method the core or foundry sand is gassed with $CO_2$ in order to harden the mould part chemically.

Therefore, a method for the production of a mould part for casting moulds is known, for example from DE 103 21 106, a core or foundry sand being used here which is produced on the basis of quartz-free sand and an inorganic binder produced from water glass. Here a mixture of a water glass binder and a basic moulding material is blended, and this is poured directly into a moulding tool.

Also known from DE 196 32 293 is a method for the production of core blanks for foundry technology, a mixture of an inorganic fire-proof foundry sand and an inorganic binding agent with a water glass base being poured here into a core box and then, in order to solidify the core, the water being withdrawn or gassed with $CO_2$.

A binding agent system based on water glass usable in these methods is described in DE 199 51 622. This consists of an aqueous alkali silicate solution additionally containing a hygroscopic base. The solid content of the alkali silicate solutions used is described as being 20 to 40%.

Moreover, from EP 0 917 499 a method is known for the production of core blanks for foundry technology wherein a mixture of an inorganic, fire-proof foundry sand and an inorganic binding agent with a water glass base is used under certain conditions when forming the core blank. Moreover, in EP 0 917 499 a method for producing a recycling core sand is described that consists of residual materials from old cores from core blanks. This means that this sand has passed through the casting process at least once, i.e. the cores have been cast, cored and then separated into grains.

Therefore, it is common to all conventional methods using an inorganic binding agent that an aqueous alkali silicate solution is mixed with a basic moulding material and then this moist mixture is introduced directly into a moulding tool. It is a disadvantage of these methods that the mixture obtained after mixing the basic moulding material and the aqueous alkali silicate solution is not stable during storage and can only be stored under certain conditions, such as in a closed moulding material container. This means that the mixture is produced respectively directly before the production of the mould part, and must then be used immediately. Moreover, it is a disadvantage that the core or foundry sand made of the basic moulding material and an aqueous alkali silicate solution is only pourable under certain conditions, and so additional measures must be taken to ensure that the core or foundry sand fills all of the cavities of a moulding tool, such as by applying negative pressure or by shaking the moulding tool. The core recycling sand described in EP 0 917 499 is also unsuitable for obtaining storage stability associated with good properties when producing a core blank since the recycling core sand can not be used directly to produce core blanks.

Therefore, the object forming the basis of the present invention is to provide a core or foundry sand which overcomes the disadvantages of the conventional core or foundry sands, and in particular provides a core or foundry sand which is stable when stored and can be used directly, without any further steps, for the production of a mould part without any risks to health or to the environment being associated with its use. Furthermore, the core or foundry sand should enable simple and reliable pouring into a moulding tool.

SUMMARY

In order to achieve the object a core or foundry sand for cores and casting moulds for the casting of molten metals is provided which comprises a basic moulding material which is coated or mixed with water glass and has a water content in the range of from≥approximately 0.25% by weight to approximately 0.9% by weight in relation to the overall weight of the core and foundry sand. The water content is understood to include the upper and lower value of the range (s). Moreover, a method for the production of a core or foundry sand according to the invention is provided as well as a method for the production of a core and a casting mould for the casting of molten metals using the core or foundry sand according to the invention.

DETAILED DESCRIPTION OF EXEMPLARY EMBODIMENTS

The water glass used according to the invention preferably has a dynamic viscosity of≥$10^2$ Pa·s, more preferably≥$10^{2.5}$ Pa·s, in particular of≥$10^3$ Pa·s. Water glass with a dynamic viscosity of≥$10^2$ Pa·s is solid. This means that the core or foundry sand according to the invention is in particular coated or mixed with solid water glass.

Moreover, the core or foundry sand according to the invention has a water content in the range of from≥approximately 0.25% by weight to approximately 0.9% by weight in relation to the overall weight of the core and foundry sand, preferably from≥approximately 0.3% by weight to approximately 0.9% by weight, in particular from≥approximately 0.3% by weight to approximately 0.9% by weight in relation to the overall weight of the core and foundry sand. When the water content of the core and foundry sand is below approximately 0.25% by weight in relation to the overall weight of the core and foundry sand, no core and foundry sand is obtained which can be used directly, in particular no core and foundry sand which can be used in the method according to the invention described below for the production of a core and a casting mould. When the water content is over approximately 0.9% by weight, no storage-stable core or foundry sand is obtained. The water content is determined according to the VDG data sheet "Testing of Clay-Bound Moulding Materials—Determination of the Water Content" P 32, section 4.1., April 1997.

The term "coated", as used within the context of the present invention, means that the individual particles of the basic moulding material are covered substantially evenly with a water glass coating. However, the term is not to be understood to mean that every individual particle of the basic moulding material must be covered separately with a water glass coating, but also includes embodiments wherein particles are only partially covered or also a number of particles are covered together with one water glass coating.

The term "mixed" as used within the context of the present invention means that the water glass is blended (homogenised) compactly with the basic moulding material.

The core or foundry sand according to the invention is characterised in that it is dry and pourable.

The pourability is determined, for example, using measuring funnels or special pourability test equipment such as that supplied by the company Karg Indusrietechnik, the pouring time with a predetermined mass or a predetermined volume being measured as a comparison indicator and being specified in seconds.

For example, the core and foundry sand according to the invention preferably has pourability of≥approximately 4 s, more preferably of≥approximately 3.5 s measured with a sample quantity of 350 g in a measuring funnel with an internal diameter at the top, wide edge of the latter of 90 mm and a total funnel height of 95 mm and a length of 32 mm and an internal diameter of the outflow tube of 15 mm at an ambient temperature of approximately 20° C.

Preferably the water glass, with which the basic moulding material is coated or mixed, comprises further additives selected from the group consisting of adhesive agent, flow improver, improvement agent for the casting surface and separating agent. The additive is preferably selected from the group consisting of sodium hydroxide, amorphous $SiO_2$, graphite, silicone oil emulsion, stearates, various oils, tensides, aluminium oxides, iron oxides, talcum, boron nitrides, magnesium oxide and various metal oxides.

Preferably the adhesive agent is selected from sodium hydroxide, hygroscopic bases and/or tensides. Additives selected from the group consisting of amorphous $SiO_2$, graphite, silicone oil, silicone oil emulsion, stearates, various oils and tensides are preferably used as flow improvers. Additives selected from the group consisting of amorphous $SiO_2$, graphite, aluminium oxides, iron oxides, talcum, boron nitrides, magnesium oxide and various metal oxides are preferably used as improvement agents for the casting surface. Additives selected from the group consisting of silicone oil, silicone oil emulsion, aluminium oxides, iron oxides, talcum, graphite and boron nitride are preferably used as separating agents. Dry, amorphous $SiO_2$ is preferably used as a drying agent and/or pouring aid.

A fire-proof mineral or synthetic sand, in particular quartz sand, zircon sand, chrome ore sand, almost spherical sand, olivine sand or mixtures of the latter, is preferably used as a basic moulding material. The basic moulding material preferably has an average grain size of approximately 0.08 mm to 0.6 mm, in particular of 0.08 mm to 0.5 mm.

Furthermore, further auxiliary materials such as pouring aids, drying agents, flow improvers, improvement agents for the casting surface and/or separating agents can be added to the coated core or foundry sand according to the invention. The further auxiliary materials are preferably selected from the group consisting of dry amorphous $SiO_2$, aluminium oxides, iron oxides, talcum, graphite and boron nitrides. The properties of the further auxiliary materials are as described above in relation to the addition of the latter to the water glass coating.

Preferably an overall quantity of additives (without water glass) of up to 4% by weight, in particular up to 3% by weight in relation to the overall weight of the core or foundry sand is added. In particular, the foundry sand according to the invention preferably does not comprise any organic additives or additional materials.

The core or foundry sand according to the invention is preferably produced by a method comprising the following steps: a) a basic moulding material according to the invention is provided, b) an aqueous solution of water glass and/or dry water glass powder is added, and c) the core or foundry sand is mixed, dried and grain-isolated.

Preferably, for this purpose in step a) a mixer is first of all filled with the basic moulding material which guarantees the homogenisation of the core or foundry sand with the binder components and optionally the additives. Paddle vane mixers, vibrating mixers, intensive mixers, whirl mixers or vertical panmills are preferably used as mixers.

In step b) an aqueous solution of water glass and/or dry/solid water glass and optionally further additives can then be added. If an aqueous solution is used, the latter preferably has a dynamic viscosity of up to $10^2$ Pa·s. Therefore the term "aqueous solution" comprises runny, thick and pasty water glasses. If a dry/solid water glass is added, the latter preferably has a dynamic viscosity of more than $10^2$ Pa·s. It is also possible to add a mixture of different water glasses and/or a mixture of an aqueous solution of water glass and dry/solid water glass. Preferably, the water glass used is an alkali silicate solution with the general composition $xSiO_2.yM_2O$ $nH_2O$, M being selected from $Li^+$, $K^+$ or $Na^+$ and x:y preferably being approximately 1:1 to 4:1, in particular approximately 2:1 to 3.5:1 (the ratio x:y also being as a module of the water glass, i.e. the quantity ratio $SiO_2$:$M_2O$). The index n then determines the quantity of $H_2O$ in the solution. Furthermore, an aqueous solution of alkali silicate is preferably used which has a solid content of no more than approximately 60% by weight in relation to the whole solution.

Preferably approximately 0.5 to approximately 8% by weight in relation to the weight of the basic moulding material of the water glass are added. In addition, an adhesive agent in a quantity of up to approximately 0.5% by weight, preferably approximately 0.1 to approximately 0.2% by weight in relation to the weight of the basic moulding material can preferably be added. Preferably the adhesive agent is an aqueous solution of sodium hydroxide, in particular an approximately 10 to approximately 50%, particularly preferably a 30% sodium hydroxide. Particularly preferably the adhesive agent is added to the basic moulding material in step b) before adding the aqueous solution of water glass.

Preferably the aqueous solution of water glass is added subsequently to the addition of the adhesive agent. By means of this sequence of the addition of the adhesive agent and the aqueous solution of water glass, with the core and foundry sand according to the invention a layer structure comprising at least two layers is achieved with which the first inner layer is formed by the adhesive agent and the second layer by the water glass. It is also possible for further layers to be applied. The latter can be applied beneath the adhesive agent layer, between the adhesive agent layer and the water glass layer and/or over the water glass layer. Within the framework of the production this layer structure can be controlled by the sequence of adding the layer-forming materials during the mixing process. The additives and/or auxiliary materials specified above, for example, can be used as layer-forming materials. The formation of a separate adhesive agent layer and a layer of water glass on top of this leads to more stable coating of the core and foundry sand with water glass which among other things can better withstand the mechanical stresses during the production process, in particular due to the paddle vane mixers, vibrating mixers, intensive mixers, whirl mixers or vertical panmills used.

A flow improver or improvement agent for the casting surface is then preferably added, preferably in quantities of up to approximately 3% by weight in relation to the weight of the basic moulding material. Particularly preferably an aqueous suspension of amorphous $SiO_2$ is added first of all, preferably in a quantity of up to approximately 3% by weight, in particular approximately 0.6 to approximately 1.0% by weight in relation to the weight of the basic moulding material, and then preferably an aqueous suspension of amorphous $SiO_2$ and graphite, preferably in a quantity of up to approximately 3% by weight, in particular approximately 0.6 to approximately 1.0% by weight in relation to the weight of the basic moulding material. The aqueous suspension is preferably approximately 10 to approximately 80%, in particular approximately 30 to approximately 60%. Finally, preferably in step b), a flow improver and/or separating agent is added in a quantity of up to approximately 1% by weight, in particular of up to approximately 0.8% by weight in relation to the weight of the basic moulding material, particularly preferably a silicone oil and/or a silicone oil emulsion.

Moreover it is also possible to dispense with the addition of all additives so that the mixture only consists of the basic moulding material and the water glass.

In one particularly preferred embodiment step b) is implemented by an adhesive agent, preferably sodium hydroxide, initially being added, then the binding agent, namely the optionally aqueous solution of water glass, then a flow improver and/or improvement agent for the casting surface, particularly preferably an aqueous suspension of amorphous $SiO_2$ and then amorphous $SiO_2$ and graphite, followed by the addition of a flow improver and/or separating agent, in particular silicone oil or a silicone oil emulsion. Particularly preferably, after the addition of each individual component the mixture is homogenised by means of the mixer. In an alternative embodiment, after adding all of the components the mixture is homogenised by means of the mixer.

In another particularly preferred embodiment in step b) water glass that is already dry/solid or a mixture of aqueous and dry/solid water glass can be added, due to which, in the case of adding dry/solid water glass it is not necessary to dry the mixture. In this embodiment mixing the production provides the most even mixture possible.

In step c) the core or foundry sand is then dried. The friction energy introduced into the mixture by the mixer is used for drying. For this purpose it is particularly preferred to use a paddle vane mixer which has a revolution speed of 160 revs/min, and mixing preferably takes place for 1 hour. By heating while constantly swirling water is withdrawn from the mixture. According to the invention the water content of the water glass, with which the basic moulding material is coated or mixed by mixing and dehydration, is set at a content in the range of approximately 0.25% by weight to approximately 0.9% by weight. In this way a core or foundry sand is obtained which is provided with a solid coating of water glass. The basic moulding material which is obtained by the method according to the invention is thus coated with water glass, at the same time a pourable core or foundry sand being obtained which is, moreover, stable when stored.

The drying can be implemented with any apparatus provided it is guaranteed that the water content of the water glass coating of the basic moulding material is maintained. Preferably external heating, hot air, radiant heating, a vacuum, negative pressure or a heating jacket can be used for this purpose.

After mixing further auxiliary materials such as pouring aids, drying agents, flow improvers, improvement agents for the casting surface or separating agents can be added to the core or foundry sand. There is preferably a quantity of up to approximately 2% by weight of each auxiliary material in relation to the weight of the basic moulding material.

Preferably before step c) at least one further additive selected from the group consisting of adhesive agent, flow improver, improvement agent for the casting surface and separating agents can additionally be added to the basic moulding material. Moreover, after step c) at least one further auxiliary material selected from the group consisting of pouring aids, drying agent, flow improver, improvement agent for the casting surface and separating agent can preferably be added to the core or foundry sand.

Preferably the core or foundry sand obtained in this way can then be filtered in order to separate out agglomerates.

The core or foundry sand according to the invention obtained in this way can than be used directly in order to produce a core or a mould part. The core or foundry sand according to the invention can, however, also be stored loose or packaged, and can be stored practically without limit due to its consistency. Therefore the core or foundry sand according to the invention can be produced separately from a method for producing the mould part and be stored, packaged or transported, which means that work is considerably facilitated and time saved for the foundries and the manufacturers of core and mould parts.

Particularly preferably the core and foundry sand according to the invention does not contain any organic additives or additional materials, and so no materials detrimental to the environment are produced when using the latter.

The core or foundry sand according to the invention is then used advantageously in a method for producing a casting mould or a core or core blank for the casting of molten metals. For this purpose, for the production of a core a) a core or foundry sand according to the invention is provided and b) a core tool or tool is filled with the core or foundry sand according to the invention. The filling can be implemented e.g. by pouring, blowing and/or injecting with a carrier medium e.g. compressed air, hot air or water vapour. This can be performed by means of a commercially available core shooter or also by suction delivery and subsequent blowing. Preferably the core or foundry sand is then compacted in the core tool.

In order to harden and solidify the core or foundry sand in order to form the core, in c) the core or foundry sand is brought into contact with at least one hardening agent, preferably water, liquids containing water and/or chemical hardening agents such as $CO_2$ within the tool. Preferably water vapour is used for this purpose. For this purpose the water vapour is preferably introduced into the tool. The water vapour can be introduced e.g. by means of a gassing plate via the injection holes and/or through the steam connection to the tool vents into the moulding material. Particularly preferably a water vapour air mixture is used which preferably contains a quantity of water of up to approximately 6% by weight in relation to the basic moulding material, in particular 3-4% by weight. The pressure is preferably up to approximately 10 bar, in particular approximately 0.5 to approximately 1.5 bar.

In order to produce a casting mould or a core or core blank the core or foundry sand according to the invention is therefore brought into a core tool or moulding tool, preferably by injecting or pouring, and is then preferably compacted. The compaction is preferably implemented by shaking and pressing. In order to harden and solidify the core or foundry sand in order to form the core, the core or foundry sand is preferably brought into contact with an aqueous solution or water within the tool. Preferably water vapour is used for this purpose. The bringing into contact with water, in particular water vapour, can preferably be implemented during step b), for example connected by time to the filling, in particular the injection of the core or foundry sand, or after pouring in the latter in a separate step c).

By bringing into contact with water the water glass coating of the core or foundry sand according to the invention is applied and softened. By softening the water glass coating binder bridges form between the particles of the core or foundry sand.

Next the core is preferably solidified, in particular by the water being removed or by chemical means. This can preferably be achieved by energy in the form of a heat carrier medium, such as in the form of hot air or a water vapour/air mixture that is conveyed through the core being introduced into the core. In a further embodiment the water can be removed by negative pressure being applied to the tool. By removing the water the water glass solidifies and a stable, solid mould part is obtained. This is therefore a substantially physical process without any additional chemical reactions being required.

In an alternative embodiment $CO_2$ can, however, be used as a hardening means and the solidification is therefore implemented substantially chemically. In a further embodiment both methods can also be implemented to solidify either simultaneously or sequentially. After hardening or solidifying (drying) the mould part the tool can be opened and the finished mould part, for example a core, can be removed.

In a further embodiment the core can only be pre-solidified, for example pre-dried, within the core tool, until the core has sufficient strength to be removed from the core tool. After this the pre-solidified core can be further solidified outside of the core tool, and in particular the pre-dried core can be completely dried, for example, in a microwave, an oven or a drying chamber.

In one preferred embodiment, in order to form the core or mould part the tool is heated during all of steps b) to c) to a temperature of from ambient temperature or approximately 20° C. to approximately 200° C., more preferably approximately 70° C. to approximately 160° C., in particular approximately 70 to approximately 120° C. Moreover, it is possible to bring the mould part into contact with water, preferably with water vapour, connected by time to the pouring of the core or foundry sand into the cavity reproducing the mould part, as already described above. It is therefore advantageously ensured that when using water vapour no liquid water is formed in the tool or condensed on the tool. Moreover, directly after pouring and bringing the core or foundry sand into contact with water the water is in turn removed from the latter, for example by heating the tool to the aforementioned temperatures. Moreover, the water can additionally or alternatively be withdrawn by using hot air and/or subjecting to hot carrier gas and/or by applying a negative pressure/vacuum. The duration of the bringing into contact with water can be for example approximately 5 mins to approximately 3 hrs.

The method is described above preferably with a sequence of steps a) to c). However, a different sequence of the steps is also possible and in accordance with this invention.

The core according to the invention or the casting mould according to the invention preferably has a bending strength of at least approximately 300 N/cm$^2$, more preferably at least approximately 400 N/cm$^2$ and in particular at least approximately 450 N/cm$^2$. The bending strength of the core is tested according to VDG data sheet P 72 "Binding agent testing, testing of cold-curing, synthetic resin-bonded moist moulding materials with hardener addition" of October 1999.

This type of core produced according to the invention can then be used to produce a casting mould for the casting of molten metals.

The advantage of the method according to the invention and the foundry sand according to the invention is that due to its pourability the foundry sand according to the invention has similar injection characteristics to those in the core or foundry sand used in the Croning method described above, and so can be introduced reliably into a moulding or core tool without any additional steps. In contrast to the Croning method the method according to the invention can however be implemented by purely physical steps in order to solidify the mould part, no substances detrimental to the environment being formed. This is advantageous since when casting the liquid metal no complex extraction systems need to be kept in the foundry, and the staff is not subjected to any gases dangerous to health such as phenolic compounds. Recycling and disposal of the inorganic core or foundry sand used are possible without any problem. During the method according to the method, in contrast to the Croning method considerably lower temperatures can be used for solidification, and this leads to a considerable saving in energy. Moreover, it has proved to be advantageous that when using the inorganically bonded cores in the permanent mould casting condensation products in the permanent mould are considerably reduced. There is therefore less effort required to clean the permanent mould after casting, and so greater permanent mould availability, by means of which increased productivity can be achieved. With the method according to the invention mould parts can be produced which have good reproduction accuracy and very sharp edges.

Furthermore, the invention relates to a core tool and a moulding tool for producing a core blank or a casting mould. The core tool is accordingly equipped with conventional core tools which are suitable for the production of a casting mould, at least one connection suitable for introducing a hardening agent, such as for example water vapour or a chemical hardening agent, being provided. Further openings can optionally be made in the core tool by means of which the hardening agent, such as the water vapour or the chemical hardening agent, can in turn escape. In particular the core tool comprises a suitable mould for producing the desired core blank or casting mould and at least one connection for introducing or injecting the core and foundry sand, as well as at least one connection for introducing a hardening agent such as water vapour or a chemical hardening agent. However, the connections can also be provided together in a connection, i.e. a connection which is suitable both for injecting the core and foundry sand and the hardening agent, such as water and/or the chemical hardening means. The connection can also be a gassing plate, and at the same time the injection holes and/or a separate steam connection to the tool vents. The core tool is preferably formed in two parts in order to remove the core blank or the casting mould easily after production.

The invention will now be illustrated by means of examples.

EXAMPLE 1

Production of the Core or Foundry Sand:

Binder Composition:

Basic moulding material: quartz sand H32

1. Adhesive agent: 0.1% by weight NaOH
2. Binder: 3.0% by weight water glass (module 2.5; 4.8% solid)
3. Flow improver/improvement agent for the casting surface 0.8% by weight suspension of amorphous $SiO_2$ and water (50%)
4. Pouring aid 0.5% by weight amorphous $SiO_2$ (The specified quantities relate to the mass of basic moulding material used)

Mixing aggregate:

Mixer type: paddle vane mixer

Revolution speed: 160 U/m

Mixing time: 1 hour

The heat energy required was introduced totally by the friction energy produced. Alternatively the mixing time could be considerably reduced by using a different mixing aggregate or an external heat source or a negative pressure.

The separation of the agglomerates was implemented with the aid of a filter with a mesh width of 1 mm.

A comparison measurement for the pourability of the foundry sand produced in Example 1 with various other core and foundry sands is shown in Table 1:

Comparison measurement with pourability test equipment made by the company Karg Industrietechnik: 350 g foundry sand, outlet Ø15 mm

TABLE 1

| Foundry sand | Throughput quantity | Throughput time |
|---|---|---|
| Quartz sand H32 (without binders) | 350 g | 3.5 s |
| Croning (H32) | 350 g | 3.3 s |
| Water glass coated, dry H32 according to Example 1 | 350 g | 3.3 s |
| Cold box (H32) | 8.2 g | Discontinued after 5 s |
| AWB sand (H32) | 6.1 g | Discontinued after 5 s |
| Hot box (H32) | 4.8 g | Discontinued after 5 s |
| Furanic resin | 2.3 g | Discontinued after 5 s |

As can be gathered from the table the core or foundry sand produced according to Example 1 has pourability just as good as that produced according to Croning and is superior to the other conventional core sands.

Core Production:

Tool parameters:

Core: bending bar (2) (dimensions: 22.5 mm×22.5 mm×185 mm)

Tool temperature: 80° C.

Introduction of the foundry sand: shaking

Temperature—water vapour/air mixture: >105° C.

Pressure of the water vapour/air mixture: 1 bar

Quantity of water in the steam/air mixture: 13 mL

Duration: 30 s

Hot air drying:

Hot air temperature: 160° C.

Gassing pressure: 1 bar

Duration: 30 s

Average core weight: 137 g

EXAMPLE 2

Comparison Tests Between a Moulding Material According to the Invention Coated with Water Glass and a Recycling Core Sand For the tests the moulding material mixtures specified in Example 1 and the following further moulding material mixtures were used:

Water glass coated moulding material

H32 +0.1% additive A+5.0% water glass binder (module (2.5)+0.8% additive C

Recycling core sand (thermally and mechanically stressed)

H32+0.1% additive A+5.0% water glass binder (module 2.5)

Pourability

The pourability was determined with a sample quantity of 350 g in a measuring funnel with an internal diameter on its upper wide edge of 90 mm and an overall funnel height of 95 mm and a length of 32 mm and an internal diameter of the outflow tube of 15 mm at ambient temperature of approximately 20° C.

Test result:

Croning moulding material pouring time: 2.9 s; 3.0 s; 3.1 s=>3.0 s (100%)

Water glass coated moulding material pouring time: 3.3 s; 3.4 s; 3.2 s=>3.3 s (90%)

H32 new sand pouring time: 3.6 s; 3.5 s; 3.5 s=>3.5 s (82%)

Recycling core sand pouring time: 3.7 s; 3.5 s; 3.6 s=>3.6 s (80%)

It is clear from the tests that the pourability of the recycling core sand is substantially poorer than that of the coated moulding material according to the invention.

Water or Moisture Portion (in Relation to the Moulding Material)

Furnace temp.: 105° C.; up to the constant weight according to VDG data sheet P32 section 4.1 of April 1997

| | tare [g] | net weight [g] | gross weight [g] | output weight [g] | loss [g] | loss [%] |
|---|---|---|---|---|---|---|
| coated | 20.4270 | 6.4748 | 26.9018 | 26.8778 | 0.024 | 0.37 |
| foundry | 19.6693 | 6.5116 | 26.1809 | 26.1553 | 0.0256 | 0.39 |
| sand | 19.8674 | 6.3598 | 26.2272 | 26.2023 | 0.0249 | 0.39 |
| | | | | | 0.0248 | 0.38 |
| recycling | 22.219 | 5.2559 | 27.4749 | 27.466 | 0.0089 | 0.17 |
| core sand | 23.7532 | 5.0026 | 28.7558 | 28.7467 | 0.0091 | 0.18 |
| | | | | | 0.0095 | 0.18 |

After the production process the water glass-coated moulding material still has a good water content or moisture portion (in relation to the moulding material weight) of 0.38%.

The recycling core sand (thermally and mechanically stressed) has a moisture content of just 0.18%.

Bending Strength:

In order to determine the bending strength test cores (test bars) were produced from both moulding material mixtures and the bending strength was measured.

Test parameters:

Tool temperature: 60° C.

Gassing pressure (water vapour): 1.1 bar

Gassing duration (water vapour): 60 s

Drying by means of negative pressure

The result was that the water glass-coated moulding material according to the invention had an average bending strength of 481 N/cm$^2$, whereas the recycling core sand could not bind and no cores could be produced from it.

The production of cores by introducing water vapour is therefore not possible with the recycling core sand, and binding could not be achieved.

The invention claimed is:

1. Core or foundry sand that can be used for producing cores and casting molds for casting of molten metals, comprising a basic molding material, a layer of an adhesive agent coating the basic molding material, and a layer of water glass lying over the adhesive agent layer, the core or foundry sand having a water content in the range of ≤ approximately 0.25% by weight to approximately 0.9% by weight in relation to the overall weight of the core or foundry sand.

2. The core or foundry sand according to claim 1, wherein the water glass comprises at least one additive selected from the group consisting of flow improver, improvement agent for the casting surface, drying agent and separating agent.

3. The core or foundry sand according to claim 1, wherein the basic molding material is selected from the group consisting of mineral and synthetic sands.

4. The core or foundry sand according to claim 1, wherein the basic molding material has an average grain size of approximately 0.08 mm to approximately 0.5 mm.

5. The core or foundry sand according to claim 1, wherein the basic molding material is selected from the group consisting of quartz sand, chrome ore sand, zircon sand, almost spherical sands and olivine sand.

6. The core or foundry sand according to claim 1, wherein the adhesive agent is selected from hygroscopic bases and/or tensides.

7. The core or foundry sand according to claim 1, wherein the adhesive agent comprises sodium hydroxide.

8. A method for producing a core or foundry sand according to claim 1, comprising the steps of:

a) providing a basic molding material, b) adding an adhesive agent and then adding water glass, and c) drying the core or foundry sand so that the water content comes within the range of ≤ approximately 0.25% by weight to approximately 0.9% by weight in relation to the overall weight of the core or foundry sand.

9. The method according to claim 8, further comprising homogenizing a mixture obtained after each of said adding steps.

10. The method according to claim 8, wherein said step c) comprises introducing friction energy when mixing or heating.

11. The method according to claim 8, wherein said step c) is implemented in a temperature range of ambient temperature up to 160° C. and for a period of time dependent upon mass of from 5 mins to 3 hrs.

12. The method according to claim 8, wherein the core or foundry sand is filtered according to said step c).

13. The method according to claim 8, wherein said step c) comprises applying a vacuum or negative pressure.

14. A method for producing a mold part of a casting mold for casting of molten metals, comprising:

a) providing a core or foundry sand according to claim 1, b) pouring the core or foundry sand into a cavity for producing the mold part, c) bringing the core or foundry sand into contact with at least one hardening agent before, during and/or after the pouring in said step b) and solidifying the mold part.

15. The method according to claim 14, wherein said step c) comprises bringing the core or foundry sand into contact with water vapor.

16. The method according to claim 14, wherein said step b) and said step c) are implemented simultaneously.

17. The method according to claim 14, during at least one of said steps b) and c), further comprising heating the cavity for producing the mold part to a temperature in a range of from approximately 20° C. to approximately 160° C.

18. The method according to claim 17, further comprising heating the cavity for producing the mold part during both of said steps b) and c).

19. The method according to claim 14, further comprising heating, during at least one of said steps b) and c), the cavity for producing the mold part to a temperature in a range of 60 to 120° C.

* * * * *